US008118564B2

(12) United States Patent
Enami et al.

(10) Patent No.: US 8,118,564 B2
(45) Date of Patent: Feb. 21, 2012

(54) MOTOR-DRIVEN COMPRESSOR

(75) Inventors: Shingo Enami, Kariya (JP); Ken Suitou, Kariya (JP); Masao Iguchi, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 817 days.

(21) Appl. No.: 11/986,386

(22) Filed: Nov. 20, 2007

(65) Prior Publication Data

US 2008/0141693 A1 Jun. 19, 2008

(30) Foreign Application Priority Data

Nov. 27, 2006 (JP) ..... P2006-318354

(51) Int. Cl.
*F04B 49/06* (2006.01)

(52) U.S. Cl. ..... 417/44.1; 417/410.1; 417/410.5

(58) Field of Classification Search ..... 417/44.1, 417/410.1, 410.3, 410.5
See application file for complete search history.

(56) References Cited

U.S. PATENT DOCUMENTS

| | | | | |
|---|---|---|---|---|
| 6,321,563 | B1 * | 11/2001 | Ikeda et al. | 62/505 |
| 6,619,933 | B2 * | 9/2003 | Ikeda | 417/410.1 |
| 6,704,202 | B1 | 3/2004 | Hamaoka et al. | |
| 7,207,187 | B2 * | 4/2007 | Funahashi et al. | 62/228.4 |
| 2003/0200761 | A1 | 10/2003 | Funahashi et al. | 62/228.4 |
| 2004/0013544 | A1 * | 1/2004 | Kimura et al. | 417/410.5 |
| 2005/0223727 | A1 | 10/2005 | Funahashi et al. | 62/228.4 |
| 2006/0064998 | A1 | 3/2006 | Funahashi et al. | 62/228.4 |
| 2006/0292023 | A1 | 12/2006 | Kim | |
| 2010/0223947 | A1 * | 9/2010 | Shibuya | 62/323.3 |

FOREIGN PATENT DOCUMENTS

| | | | |
|---|---|---|---|
| CN | 1189660 | C | 2/2005 |
| EP | 1 382 847 | A2 | 1/2004 |
| EP | 1 450 044 | A2 | 8/2004 |
| JP | 2002-70743 | | 3/2002 |
| JP | 2003-322082 | | 11/2003 |
| JP | 2005-113695 | | 4/2005 |
| JP | 2005-344689 | | 12/2005 |
| JP | 2006-177214 | | 7/2006 |
| KR | 10-0643195 | B1 | 11/2006 |

OTHER PUBLICATIONS

First Office Action for Chinese Patent Application No. 200710306134.6, (3 pages).
European Search Report for Application No. 07121494.4-2315, dated Nov. 17, 2009.

* cited by examiner

*Primary Examiner* — Charles Freay
*Assistant Examiner* — Patrick Hamo
(74) *Attorney, Agent, or Firm* — Locke Lord LLP

(57) ABSTRACT

A motor-driven compressor includes a compression mechanism for compressing a refrigerant gas, an electric motor, an inverter assembly and an inverter chamber. The electric motor drives the compression mechanism. The inverter assembly converts direct-current power into polyphase alternating-current power to supply to the electric motor and controls a rotational speed of the electric motor. A substrate having an electric circuit and an electronic component connected to the substrate are provided in the inverter assembly. The inverter chamber detachably accommodates the inverter assembly. A vibration damping member is arranged in the inverter assembly.

13 Claims, 3 Drawing Sheets

MOTOR-DRIVEN COMPRESSOR

BACKGROUND OF THE INVENTION

The present invention relates generally to a motor-driven compressor, and more particularly to a motor-driven compressor having an inverter for driving an electric motor.

The motor-driven compressor has an electric motor for driving a compression mechanism of the compressor and an inverter for controlling and driving the electric motor. The motor-driven compressor is often installed and used in a vehicle and has a problem of vibration developed by an internal combustion engine.

If any frequency spectrum of the vibration developed by the internal combustion engine encompasses the resonance frequency of the inverter substrate, the substrate resonates with the vibration of the internal combustion engine and the stress of a solder or the like on the substrate is increased. If the stress on the solder is increased, problems occur so that cracks are generated in the leads (or pins) which are connected to the substrate by the solder.

To prevent the above problems, a gel material is enclosed for damping or suppressing the vibration in a conventional inverter type motor-driven compressor. That is, an inverter chamber of the motor-driven compressor is filled with vibration-damping gel thereby to fix and seal the inverter and its elements. Thus, the inverter and the substrate are fixed, so that the vibration is restrained. The motor-driven compressor having such an inverter is disclosed in the Japanese Patent Application Publication No. 2003-322082.

However, the inverter whose chamber is filled with the gel is undetachably fixed. Therefore, the use of the vibration-damping gel is not suitable to a motor-driven compressor having such an inverter that needs to be removed as required.

Furthermore, since substantially the entire space of the inverter chamber should be filled with the gel, the inverter with such a chamber becomes heavier. Additionally, the need of high-temperature treatment for curing the gel requires large-sized equipment for raising the inverter chamber temperature, with the result that the production cost is increased and harmful load is inevitably applied to electronic components due to the high-temperature treatment.

The present invention is directed to a motor-driven compressor which is capable of reducing the vibration of an inverter substrate without filling inverter chamber with vibration-damping gel.

SUMMARY OF THE INVENTION

In accordance with an aspect of the present invention, a motor-driven compressor includes a compression mechanism for compressing a refrigerant gas, an electric motor, an inverter assembly and an inverter chamber. The electric motor drives the compression mechanism. The inverter assembly converts direct-current power into polyphase alternating-current power to supply to the electric motor and controls a rotational speed of the electric motor. A substrate having an electric circuit and an electronic component connected to the substrate are provided in the inverter assembly. The inverter chamber detachably accommodates the inverter assembly. A vibration damping member is arranged in the inverter assembly.

Other aspects and advantages of the invention will become apparent from the following description, taken in conjunction with the accompanying drawings, Illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
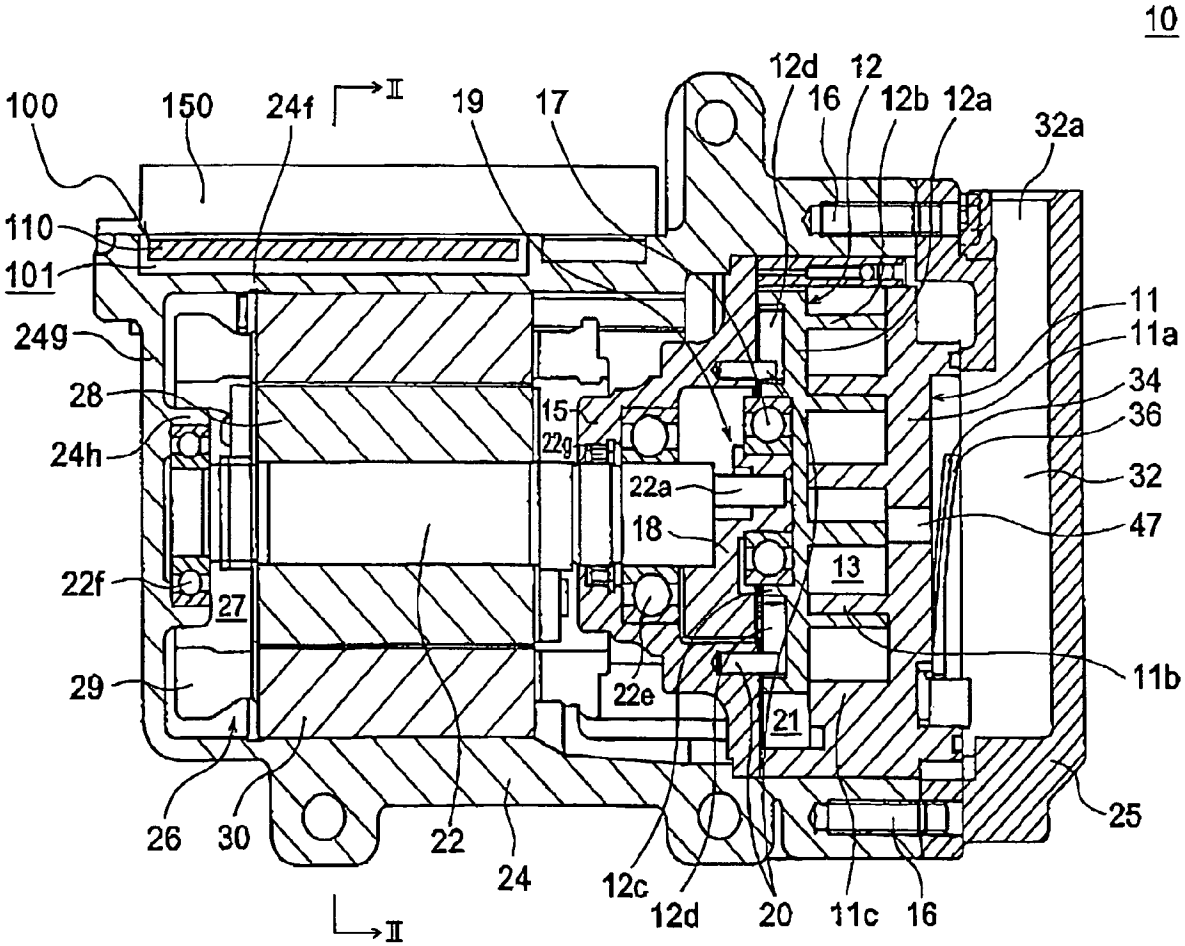
FIG. 1 is a longitudinal cross sectional view of a motor-driven compressor according to a first embodiment of the present invention.
Figure 2:
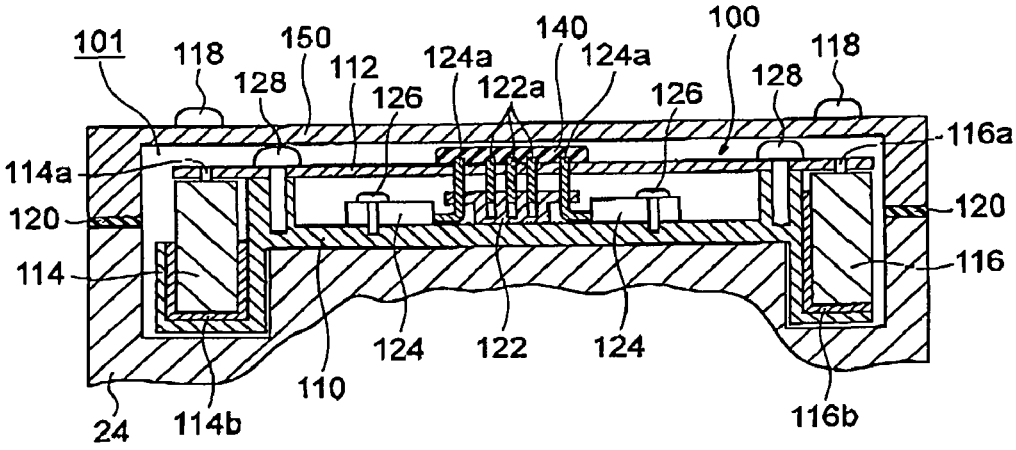
FIG. 2 is a fragmentary view showing an inverter assembly of the motor-driven compressor of FIG. 1.
Figure 3:
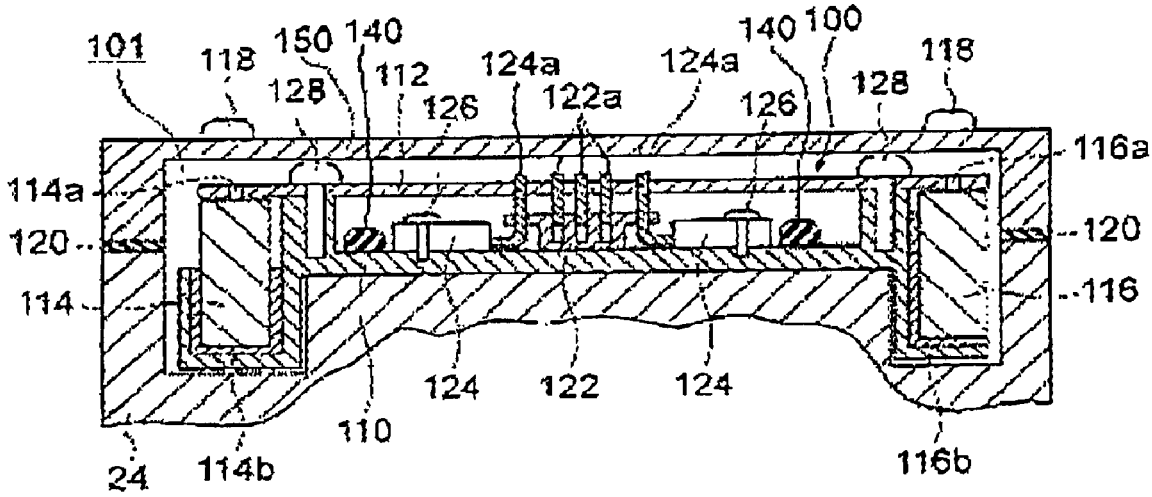
FIG. 3 is a fragmentary view showing an inverter assembly of the motor-driven compressor of FIG. 1 according to an alternative embodiment.

The following will describe a motor-driven compressor of a first preferred embodiment according to the present invention with reference to FIG. 1 through FIG. 3. FIG. 1 shows a motor-driven compressor 10 according to the first preferred embodiment. The motor-driven compressor 10 includes a first housing 24 and a second housing 25, which are fixed to each other by a plurality of bolts 16. The first housing 24 is formed in a cylindrical shape, including a cylindrical portion 24*f* and a closed bottom portion 24*g*. An annular shaft support portion 24*h* extends from the internal end face of the bottom portion 24*g* of the first housing 24.

In FIG. 1, the right side of the drawing or the side of the second housing 25 corresponds to the front side of the motor-driven compressor 10, and the left side of the drawing or the side of the first housing 24 to the rear side of the motor-driven compressor 10.

The motor-driven compressor 10 has a fixed scroll member 11 and a movable scroll member 12 which cooperate to define therebetween a compression chamber 13. The fixed scroll member 11 has a fixed base plate 11*a* with a disk shape, a fixed scroll wall 11*b* having a spiral shape and extending from the fixed base plate 11*a* and an outermost fixed scroll wall 11*c*. The fixed base plate 11*a* has a discharge port 47 formed therethrough and at the center thereof. The fixed scroll member 11, the movable scroll member 12 and the compression chamber 13 cooperate to form a compression mechanism of the motor-driven compressor 10 for compressing a refrigerant gas.

The movable scroll member 12 has a movable base plate 12*a* with a disk shape and a movable scroll wall 12*b* having a spiral shape and extending toward the front of the motor-driven compressor 10 from the movable base plate 12*a*. The movable scroll member 12 is formed with an annular boss 12*c* extending toward the rear of the motor-driven compressor 10 from the center of the movable base plate 12*a* for holding therein a ball bearing 17.

The motor-driven compressor 10 has a crank mechanism 19 through which the movable scroll member 12 performs an orbital motion with respect to the fixed scroll member 11 and pins 20 for preventing the movable scroll member 12 from rotating. The pins 20 are mounted to a shaft support member 15 and loosely fitted in an annular recess 12*d*. The crank mechanism 19 includes the boss 12*c*, a crank pin 22*a* of the drive shaft 22 and the ball bearing 17 for supporting the crank pin 22*a* through a bushing 18.

The drive shaft 22 is disposed in the motor-driven compressor 10, extending through the electric motor 26 at the center thereof. The electric motor 26 used for driving the compression mechanism is a three-phase synchronous motor. The electric motor 26 includes the drive shaft 22, a rotor 28 fitted on the drive shaft 22 and a stator 30 located outside the rotor 28 and having a coil 29 wound therearound.

The first housing 24 has an Inverter chamber 101 formed in the outer periphery adjacent to the rear end thereof in the form of a recess. An inverter assembly 100 is accommodated in the inverter chamber 101. It is noted that FIG. 1 shows only the base 110 of the inverter assembly 100 for the sake of simplicity of illustration, but the inverter assembly 100 will be described in detail in later part hereof with reference to FIG. 2.

The inverter assembly 100 is electrically connected to the electric motor 26 through an airtight terminal 122 provided in the first housing 24 (which will be described later with reference to FIG. 2). The inverter assembly 100 is operable to convert direct-current power supplied from an external device into polyphase alternating-current power, then supply the power to the electric motor 26 and control a rotational speed of the electric motor 26.

The first housing 24 has a cover 150 mounted thereon for covering the inverter assembly 100 and separating the Inverter chamber 101 from the outside of the first housing 24. A part of the outer wall of the motor-driven compressor 10 is provided by the cover 150. That is, the cover 150, the first housing 24 and the second housing 25 cooperate to separate the inside of the motor-driven compressor 10 from the outside of the first housing 24. The cover 150 and the first housing 24 cooperate to define the outer wall of the Inverter chamber 101. The inverter assembly 100 is disposed at the top of the first housing 24 above the drive shaft 22, as seen in FIG. 1, when the motor-driven compressor 10 is used.

The drive shaft 22 is supported at the front end thereof adjacent to the crank mechanism 19 by the shaft support member 15 through a ball bearing 22*e* and at the opposite rear end thereof by a shaft support portion 24*h* of the first housing 24 through a ball bearing 22*f*. A seal member 22*g* is provided behind the ball bearing 22*e* for sealing between the drive shaft 22 and the shaft support member 15.

Fluid as a refrigerant gas flows in a space covered by the first housing 24 and the second housing 25. In this space, the first housing 24 and the shaft support member 15 cooperate to define a motor chamber 27, and the first housing 24, the second housing 25 and the shaft support member 15 also cooperate to define a crank chamber 21. The motor chamber 27 is connected to the crank chamber 21 through a suction passage (not shown).

The fixed scroll member 11 and the second housing 25 cooperate to define a discharge chamber 32 on the opposite side of the compression chamber 13 relative to the discharge port 47. Refrigerant gas is compressed in the compression chamber 13, and then flowed into the discharge chamber 32 through the discharge port 47. A reed valve 34 and a retainer 36 are provided in the discharge chamber 32 for preventing backflow of the refrigerant gas, that is, a flow of the refrigerant gas from the discharge chamber 32 toward the discharge port 47. The discharge chamber 32 has an outlet 32*a* which provides fluid communication between the discharge chamber 32 of the motor-driven compressor 10 and the external refrigeration circuit out of the motor-driven compressor 10.

In the motor-driven compressor 10 having the above structure, refrigerant gas to be compressed flows from the suction side of the external refrigeration circuit into the motor chamber 27 through a suction port (not shown). Then, the refrigerant gas flows from the motor chamber 27 into the crank chamber 21 through a suction passage (not shown) and the compression chamber 13 in communication with the crank chamber 21. In the compression chamber 13, the refrigerant gas is compressed by orbital movement of the movable scroll member 12 in accordance with the rotation of the drive shaft 22 and the compressed refrigerant gas flows through the discharge port 47 into the discharge chamber 32. Subsequently, the refrigerant gas is discharged out of the motor-driven compressor 10 through the outlet 32*a*.

FIG. 2, which is a fragmentary cross sectional view taken along the line II-II of FIG. 1, shows the inverter assembly 100 and peripheral structure thereof.

A gasket 120 is interposed between the cover 150 and the first housing 24 for sealing the inverter chamber 101. The gasket 120 is made of a metal plate as a base plate surrounded by rubber.

The inverter assembly 100 includes a substrate 112 having an electric circuit and the base 110 for supporting the substrate 112. The substrate 112 is fixed to the base 110 by screws 128.

The cover 150, the base 110 and the first housing 24 are fastened together by screws 118. It is noted that the screws 118 are located at positions different from the illustration of FIG. 2, so that only the heads of the screws 118 are shown in the drawing and the portions of the inverter assembly 100 fastened by the screws 118 are not shown. The inverter assembly 100 includes various electronic components such as a capacitor 114, a coil 116, an airtight terminal 122, an IGBT (insulated gate bipolar transistor) 124 and a varistor (not shown) which are connected to the substrate 112.

The substrate 112 has at the center thereof a damper weight 140 made of a potting material with a certain weight and serving as a vibration damping member for reducing the vibration produced in the substrate 112. The damper weight 140, which is not a member for fixing the substrate 112 to the other components such as the cover 150 and the base 110 to support such components, may be so mounted on the substrate 112 that it is not in contact with the above components. In addition, the damper weight 140 is not in contact with the outer wall of the inverter chamber 101. The resonance frequency when the substrate 112 and the damper weight 140 are vibrated together is shifted by mounting the damper weight 140 on the substrate 112. The weight of the damper weight 140 is determined such that due to this shift the resonance frequency is out of the range of the frequency spectrum of the vibration produced in the internal combustion engine. Alternatively, the weight of the damper weight 140 is determined such that the resonance frequency shifts at least to the frequency range with smaller amplitude of the vibrations produced by the internal combustion engine.

Since the damper weight 140 is not intended to directly suppress the deformation of the substrate 112, the damper weight 140 is used neither like a gel to fill the spaces between the substrate 112 and cover 150 and between the substrate 112 and the base 110, nor to cover the entire substrate 112.

In mounting the damper weight 140 on the substrate 112, the semifluid potting material is put on the substrate 112 and then allowed to be solidified and adhered to the substrate 112 over time.

The capacitor 114 is provided by an electrolytic capacitor with a lead 114*a* which is soldered to the substrate 112 to electrically connect the capacitor 114 to the electric circuit of the substrate 112. The capacitor 114 is fixed to the substrate 112 by the lead 114*a* and solder around the lead 114*a* (not shown) and adhered fixedly to the base 110 by resin adhesive 114*b*.

The coil 116 has a lead 116*a* which is soldered to the substrate 112 to electrically connect the coil 116 to the electric circuit of the substrate 112. The coil 116 is fixed to the substrate 112 by the lead 116*a* and solder around the lead 114*a* (not shown) and adhered fixedly to the base 110 by resin adhesive 116*b*.

The IGBT 124 has a lead 124*a* which is soldered to the substrate 112 to electrically connect the IGBT 124 to the electric circuit of the substrate 112. The IGBT 124 is fixed to the base 110 by screws 126.

The airtight terminal 122 has a lead 122*a* which is soldered to the substrate 112 to electrically connect the airtight terminal 122 to the electric circuit of the substrate 112. The airtight terminal 122 is fixed to the base 110. Though not shown in the drawing, the airtight terminal 122 electrically connects the inverter assembly 100 to the electric motor 26 (refer to FIG. 1) in the first housing 24 and air-tightly separates the inverter chamber 101 from the motor chamber 27 which accommodated therein the electric motor 26.

A refrigerant passage (not shown) is formed between the first housing 24 and the stator 30 (FIG. 1). The refrigerant gas flowing in this passage cools the inverter assembly 100 through the first housing 24 and also cools the electric motor 26 through the stator 30.

The inverter assembly 100 is assembled with the substrate 112, the capacitor 114 and the coil 116 supported by the base 110. As described above, the base 110 is fastened to the first housing 24 by the screws 118 and, therefore, the inverter assembly 100 is fastened to the first housing 24. Thus, the inverter assembly 100 is detachably mounted to the first housing 24 by means of the screws 118.

In assembling the motor-driven compressor 10, firstly the inverter assembly 100 is completed, for example, by firstly installing various electronic parts on the base 110, fastening the substrate 112 to the base 110 by the screws 128 and then connecting various electronic parts to the substrate 112.

After assembling the inverter assembly 100 has been thus completed, the inverter assembly 100 is mounted to the motor-driven compressor 10. The cover 150, the base 110 and the first housing 24 are fastened together by the screws 118.

Because the inverter chamber 101 is not filled with gel, the base 110 may be removed from the first housing 24 by taking out the screw 118, so that the inverter assembly 100 can also be removed from the first housing 24. Thus, the integral-type inverter assembly 100 is of a cartridge-type and it is detachably accommodated in the inverter chamber 101 of the motor-driven compressor 10.

The inverter assembly 100 of the motor-driven compressor 10 operates to suppress the vibration of the substrate 112 as follows.

The damper weight 140 mounted on the substrate 112 increases the weight of a portion of the substrate 112 which is vibrated together with the substrate 112. This shifts the resonance frequency of the substrate 112 to a higher range that is out of the frequency spectrum of the vibration produced by the internal combustion engine. Thus, the substrate 112 does not resonate with the vibration of the internal combustion engine and vibration energy of the substrate 112 is decreased, accordingly. Therefore, the stress applied to the solder and the leads for electronic component such as the leads 114*a*, 116*a*, 122*a* and 124*a* is decreased. If the resonance frequency does not shift out of the above range, the resonance frequency shifts to a spectrum which has a smaller amplitude, at least the stress is reduced.

The damper weight 140, which is made of a potting material, is soft after solidification and deformable adequately by the vibration, thus absorbing vibration energy to decrease the vibration level.

According to the inverter assembly 100 and the motor-driven compressor 10 of the first preferred embodiment wherein the damper weight 140 is mounted on the substrate 112 to reduce the vibration of the substrate 112. Therefore, the vibration of the substrate 112 is reduced by the damper weight 140 without using gel in the inverter chamber 101.

Because the inverter chamber 101 is not filled with gel, the inverter assembly 100 is detachable from the first housing 24 of the motor-driven compressor 10 by removing the screw 118.

The damper weight 140 is mounted at the center of the substrate 112 where the amplitude of vibration of the substrate 112 is large. Thus, the reduction of vibration and the shift of resonance frequency are done effectively at the position where the vibration energy is large.

The inverter of the motor-driven compressor 10 of the present embodiment differs from conventional motor-driven compressor in that the inverter chamber 101 is not filled with gel. The damper weight 140 is made of a resin and its volume is much smaller than that of the inverter chamber 101, so that the overall weight of the motor-driven compressor 10 can be reduced.

According to the motor-driven compressor 10 of the first preferred embodiment, having no gel in the inverter chamber 101, high temperature treatment for consolidating gel can be dispensed with. Thus, a large-sized equipment for the treatment is unnecessary, so that the production cost is reduced and the treatment placing the electronic components under a load of high temperature can be avoided.

The damper weight 140 does not need to be in direct contact with the other components such as the cover 150 or the base 110 and, therefore, the damper weight 140 may be mounted on the substrate 112 at any time before the cover 150 is mounted on the motor-driven compressor 10. Additionally, such arrangement of the damper weight 140 helps to increase the freedom in shape and mounting position of the damper weight 140.

In the first preferred embodiment, the damper weight 140 is made of a potting material or a resin. According to the present invention, the damper weight 140 may be made of any other suitable non-conducting material. The material of the damper weight 140 does not necessarily contain resin. Additionally, the damper weight 140 may have any other shape or structure, or it may be mounted in any other way, if the damper weight 140 performs the function as a vibration damping member for reducing the vibration of the substrate 112 or shifting a resonance frequency of the substrate 112 to a high range.

The damper weight 140 is mounted at the center of the substrate 112, as shown in FIG. 2. The position of mounting the damper weight 140 is not limited to the above center position, but it may be mounted at any other position or mounted at dispersed plural positions. For example, the damper weight 140 may be mounted at any position where amplitude of the substrate 112 in vibrating is large. The position where the amplitude becomes large includes a position where the amplitude is locally maximized. This is determined depending on the shape of the substrate 112, the position and the number of the screw 128 and the conditions of each of the electronic components such as the weight, the mounting position and the fixed condition of the capacitor 114.

The damper weight 140 may be mounted to any member of the inverter assembly 100 other than the substrate 112. For example, the damper weight 140 may be mounted on the base 110 to reduce vibration of the base 110 as shown in FIG. 3, thereby to reduce the vibration transmitted from the base 110 to the substrate 112.

In the first preferred embodiment, the motor-driven compressor 10 has been described as a scroll type compressor. However, the motor-driven compressor 10 is not limited to the scroll type compressor, but it may be of any type compressor having a compression mechanism for compressing a fluid.

Therefore, the present examples and embodiments are to be considered as illustrative and not restrictive, and the invention is not to be limited to the details given herein but may be modified within the scope of the appended claims.

What is claimed is:

1. A motor-driven compressor mounted to an engine of a vehicle comprising:

a compression mechanism for compressing a refrigerant gas;

an electric motor for driving the compression mechanism;

an inverter assembly for converting direct-current power into polyphase alternating-current power to supply to the electric motor and controlling a rotational speed of the electric motor, wherein the inverter assembly comprises, as members thereof, a substrate having an electric circuit and an electronic component connected to the substrate; and an inverter chamber detachably accommodating the inverter assembly, wherein a vibration damping member is arranged in the inverter assembly, and the weight of the vibration damping member is determined such that a resonance frequency of the substrate, to which the vibration damping member is mounted, shifts at least to the frequency range with smaller amplitude of vibrations produced by the engine, wherein the vibration damping member is not in contact with the outer wall of the inverter chamber during standstill of the compressor.

2. The motor-driven compressor according to claim 1, wherein the vibration damping member is mounted on the substrate.

3. The motor-driven compressor according to claim 2, wherein the vibration damping member is mounted at the center of the substrate.

4. The motor-driven compressor according to claim 2, wherein the Inverter assembly includes a base for supporting the substrate, and the vibration damping member is not in direct contact with the base and the outer wall of the inverter chamber.

5. The motor-driven compressor according to claim 1, wherein the inverter assembly includes a base for supporting the substrate, and the vibration damping member is mounted on the base.

6. The motor-driven compressor according to claim 5, wherein vibration damping member is not in direct contact with the substrate and the outer wall of the inverter chamber.

7. The motor-driven compressor according to claim 1, wherein the vibration damping member is mounted at a position where amplitude of vibration of the substrate is locally maximized.

8. The motor-driven compressor according to claim 1, wherein the vibration damping member is made of a non-conducting material.

9. The motor-driven compressor according to claim 8, wherein the non-conducting material includes a resin.

10. The motor-driven compressor according to claim 1, wherein the vibration damping member is used for reducing the vibration of the substrate.

11. The motor-driven compressor according to claim 1, wherein the vibration damping member is used for shifting the resonance frequency of the substrate.

12. The motor-driven compressor according to claim 1, wherein the inverter assembly further comprises, as members thereof, a rigid base for supporting the substrate, the substrate is fixedly attached to the base.

13. A motor-driven compressor mounted to an engine of a vehicle comprising:

a compression mechanism for compressing a refrigerant gas;

an electric motor for driving the compression mechanism;

an inverter assembly for converting direct-current power into polyphase alternating-current power to supply to the electric motor and controlling a rotational speed of the electric motor, wherein the inverter assembly comprises, as members thereof, a substrate having an electric circuit and an electronic component connected to the substrate, and a rigid base for supporting the substrate, the substrate is fixedly attached to the base; and an inverter chamber detachably accommodating the inverter assembly, wherein a vibration damping member is arranged in the inverter assembly, and the weight of the vibration damping member is determined such that a resonance frequency of the substrate, to which the vibration damping member is mounted, shifts at least to the frequency range with smaller amplitude of vibrations produced by the engine.

* * * * *